US007357678B1

(12) United States Patent
Lee et al.

(10) Patent No.: US 7,357,678 B1
(45) Date of Patent: Apr. 15, 2008

(54) SIM CARD CONNECTOR

(75) Inventors: Yun-Chien Lee, Taipei Hsien (TW); Shu-Man Chiang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/552,911

(22) Filed: Oct. 25, 2006

(51) Int. Cl.
*H01R 24/00* (2006.01)

(52) U.S. Cl. ..... 439/630; 439/188; 439/862
(58) Field of Classification Search ..... 439/630, 439/188, 862
See application file for complete search history.

(56) References Cited

U.S. PATENT DOCUMENTS

| | | | | |
|---|---|---|---|---|
| 6,126,464 | A | 10/2000 | Chang | 439/188 |
| 6,129,570 | A | 10/2000 | Griffin et al. | 439/260 |
| 6,135,809 | A | 10/2000 | Asakawa | 439/489 |
| 6,296,500 | B1 | 10/2001 | Liao | 439/188 |
| 6,305,960 | B1 | 10/2001 | Fan | 439/188 |

*Primary Examiner*—Tho D. Ta
(74) *Attorney, Agent, or Firm*—WPAT, PC; Anthony King

(57) ABSTRACT

A SIM card connector includes a connector body. The connector body defines a receptacle channel that extends inwardly from the front. The receptacle channel further defines a first hole and a second hole. Pluralities of terminals mount in the middle of the connector body. A switch terminal mounts in the connector body. The switch terminal has a fixing portion received in the first hole and a contacting portion received in the second hole. The contacting portion forms an arced surface. The top of the arced surface is inserted into the second hole and protrudes above the top surface of the housing base in the receiving cavity.

4 Claims, 8 Drawing Sheets

SIM CARD CONNECTOR

BACKGROUND OF THE INVENTION

1. Field of the Invention

The present invention relates to a SIM card connector, and more particularly to a SIM Card connector capable of avoiding erroneous insertion of card.

2. The Related Art

SIM (Security Identification Module) cards used in Global System for Mobile (GSM) cell phones are essentially smart cards that identify a unique subscriber to a wireless network and describe the services that the subscriber is entitled to receive. Since SIM cards are tied to a single subscriber, they are exchangeable between any handset that the subscriber chooses to use. SIM cards are mounted inside handsets on SIM card connectors.

FIG. 13 shows a traditional SIM card connector 300 receiving a SIM card 200. The end of the connector 300 has a triangle lump. The end of the SIM card 200 has a triangle gap to couple with the triangle lump of the SIM card connector 300 for avoiding erroneous insertion of card.

Conventionally, the SIM card 200 is frequently removed from the SIM card connector 300 in common uses. When the SIM card 200 is erroneously inserted in the traditional SIM card connector 300, the rectangular rim of the SIM card 200 opposite to the triangle gap frequently collides with the triangle lump of the connector 300. When the collision is occurred between the SIM card connector 300 and the SIM card 200 frequently, the SIM card connector 300 and the SIM card 200 are easily damaged. So the SIM card connector 300 is required to withstand sudden shock loads without fracturing.

SUMMARY OF THE INVENTION

An object of the present invention is to provide a SIM card connector capable of avoiding erroneous insertion of SIM card and avoid the damage occurred therebetween.

In order to fulfill the above object, the present invention provides a SIM card connector which includes a connector body, a plurality of terminals and a switch terminal. The connector body defines a receptacle channel that extends inwardly from the front. The receptacle channel further defines a first hole and a second hole. Pluralities of terminals mount in the middle of the connector body. The switch terminal mounts in the connector body. The switch terminal has a fixing portion received in the first hole and a contacting portion received in the second hole. The contacting portion forms an arced surface. The top of the arced surface is inserted into the second hole and protrudes above the top surface of the housing base in the receiving cavity.

The switch terminal arranged in the SIM card connector avoids the damage of the collision between the SIM card and the SIM card connector when the SIM card is erroneously inserted into the SIM card connector.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
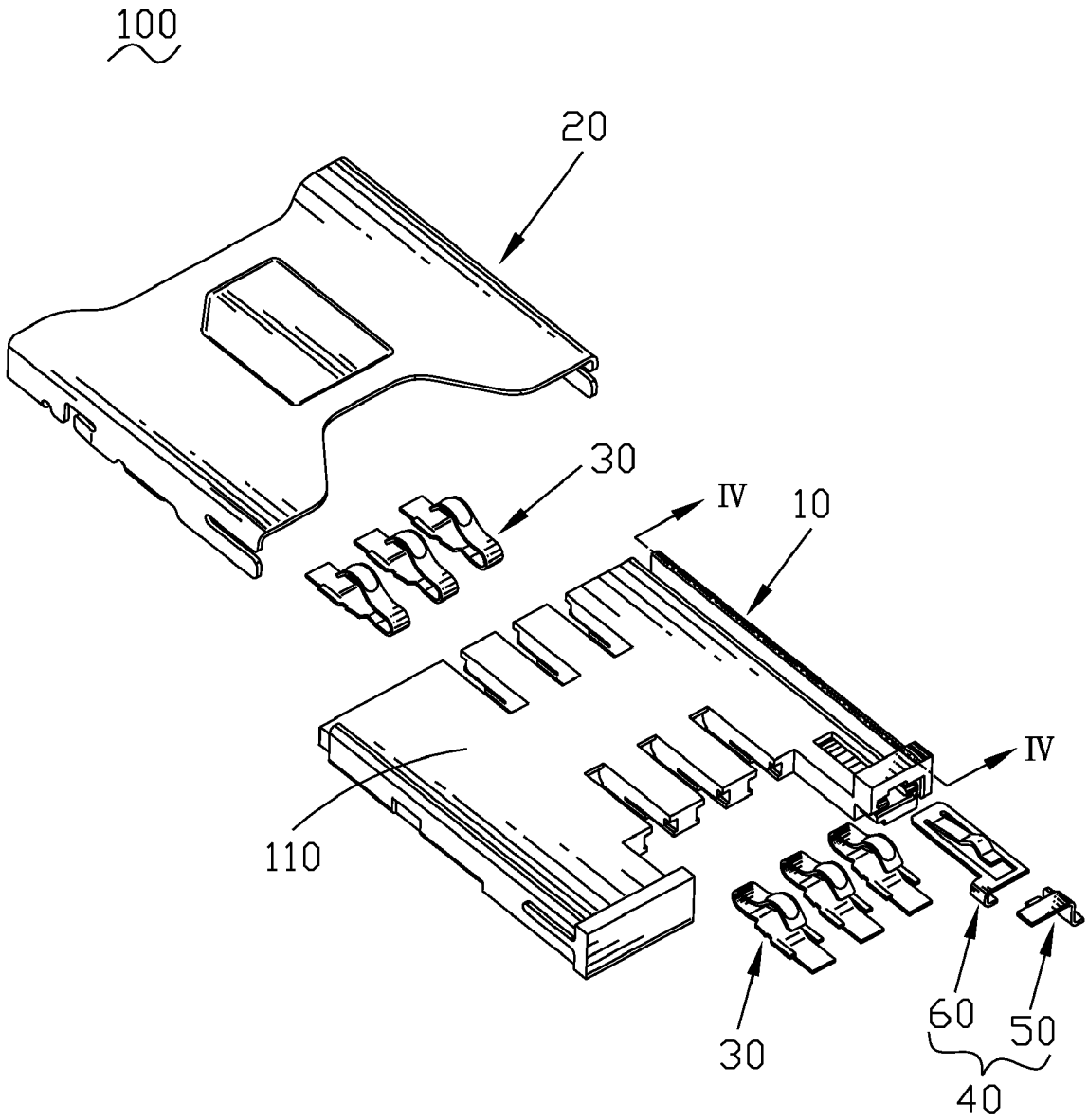
FIG. 1 is an exploded view of a SIM card connector according to the present invention.

For facilitating understanding, like components are designated by like reference numerals throughout the various embodiments of the invention as shown in the attached drawings.

Figure 10:
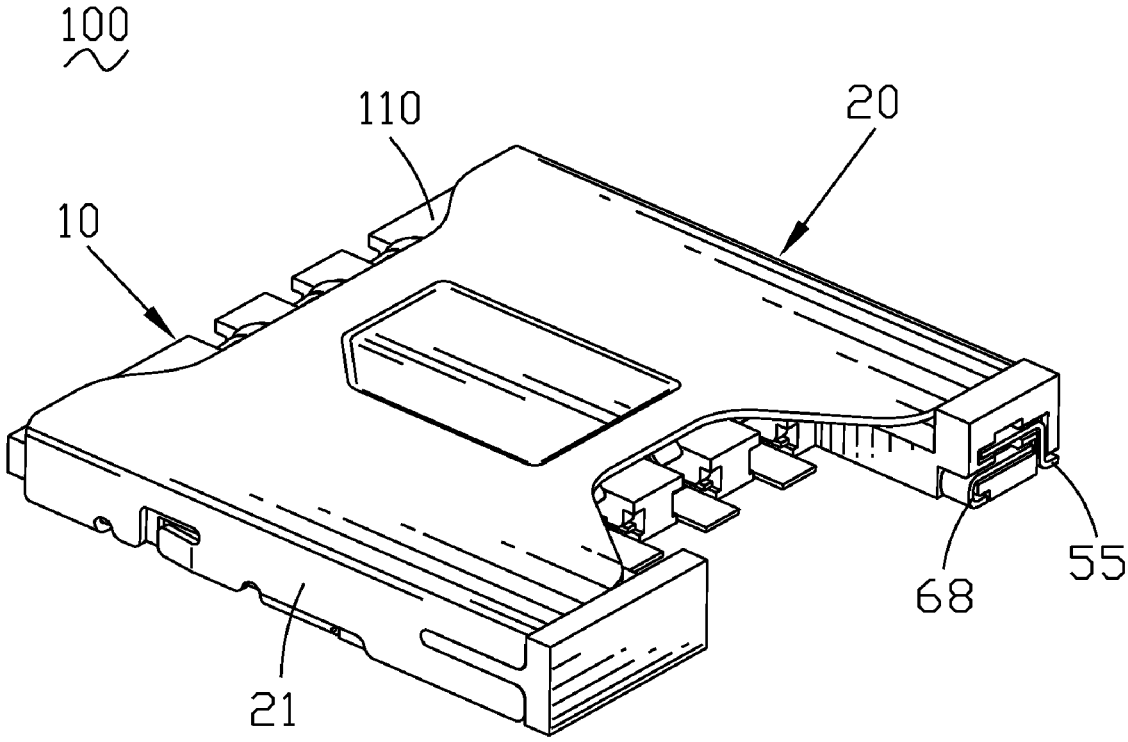
FIG. 10 is a perspective view of the SIM card connector.

FIG. 1 and FIG. 10 show a SIM card connector 100 capable of avoiding erroneous insertion of card according to the present invention. The SIM card connector 100 includes a connector body 10, a plurality of terminals 30 mounting in the middle of the connector body 10, a switch terminal 40 mounting in the lateral of the connector body 10, and a cover 20 mounted on the connector body 10 to define a receiving cavity 110 therebetween for receiving a SIM card 200 in given. The switch terminal 40 has a fixing portion 50 and a contacting portion 60. The contacting portion 60 elastically contacts with the fixing portion 50. The left side and the right side of the cover 20 both extend downwards and form a lateral wall 21. The lateral wall 21 couples to the side of the connector body 10.

Figure 2:
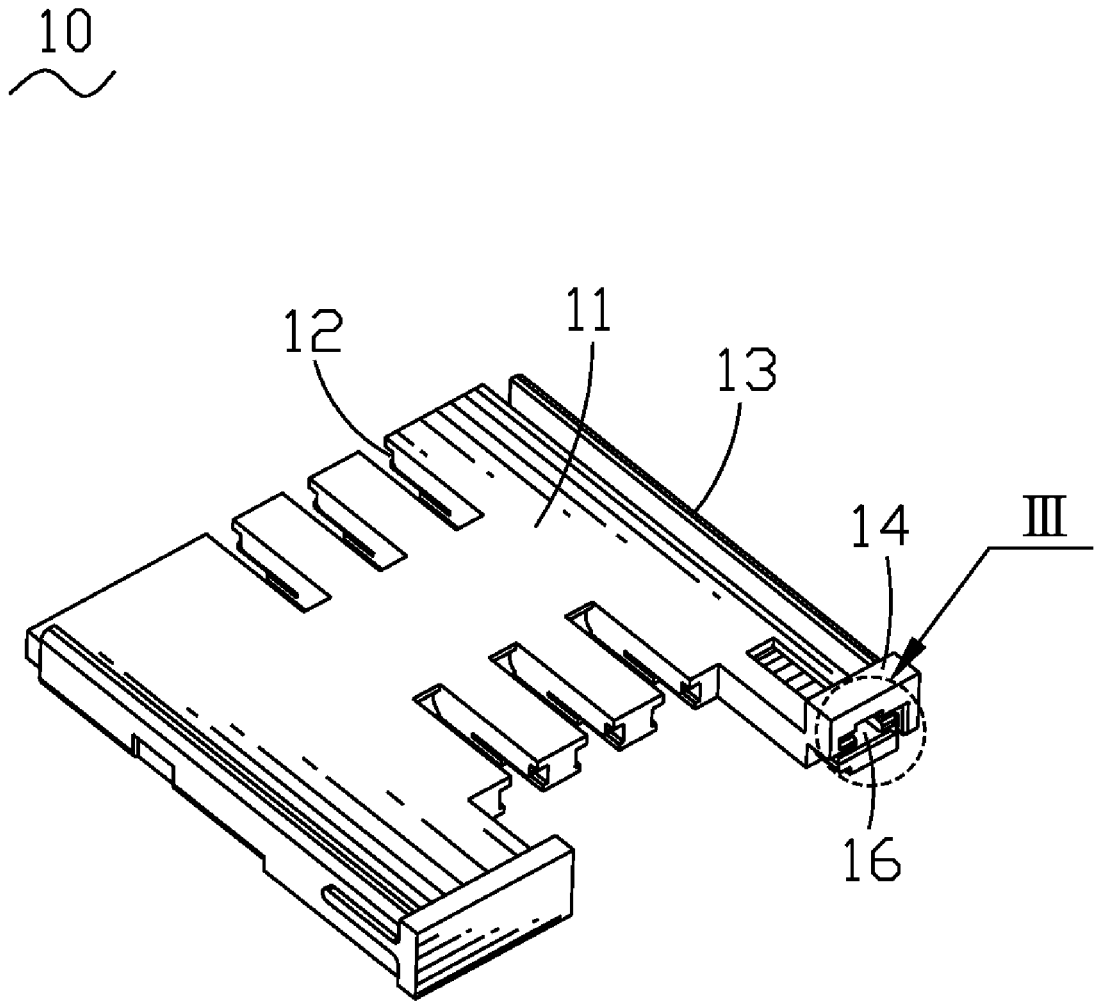
FIG. 2 is a perspective view of a connector body in a SIM card connector.

Referring to the FIG. 2, the connector body 10 has a housing base 11, The housing base 11 defines a plurality of grooves 12 arranged side-by-side in the middle portion thereof. The housing base 11 has a pair of sidewalls 13 extending upwardly from two opposite sides thereof and a stopping bar 14 extending upwardly from the front end of the housing base 11. The housing base 11 defines a receptacle channel 16 that extends inwardly from the stopping bar 14. The switch terminal 40 is received in the receptacle channel 16.

Figure 3:
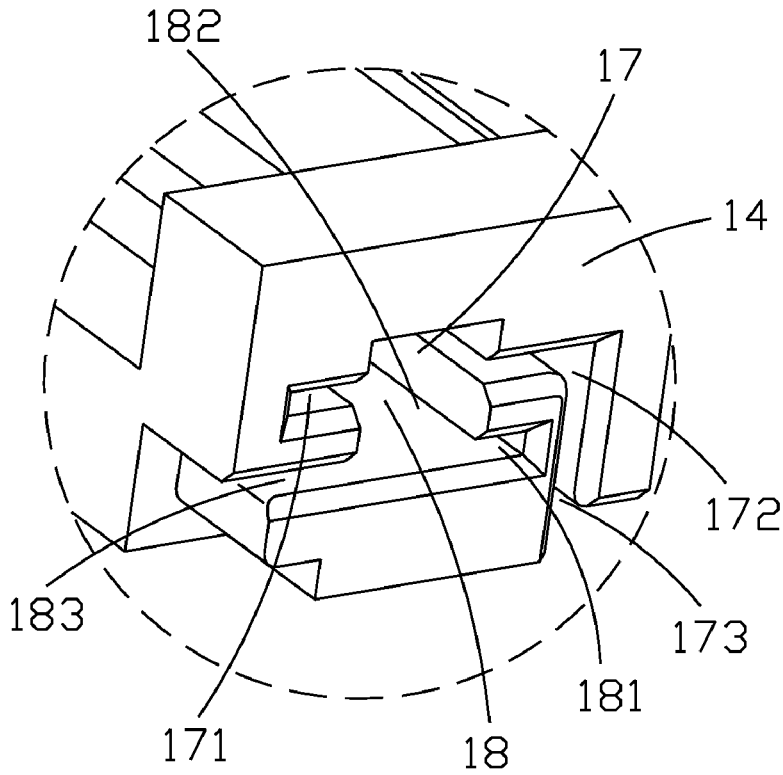
FIG. 3 is a partial enlarged view of III portion of FIG. 2.
Figure 4:
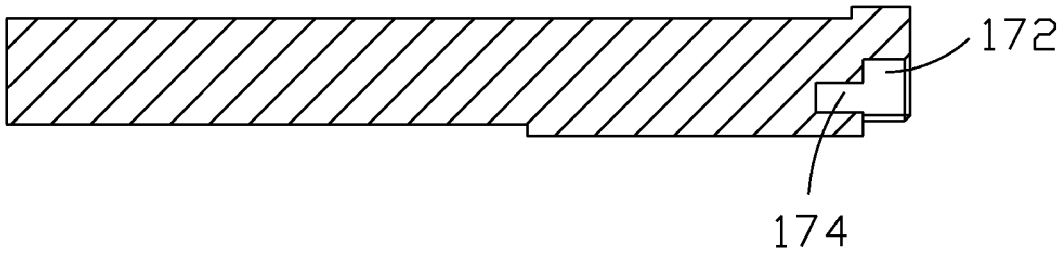
FIG. 4 is a cross-sectional view taken along line IV-IV of FIG. 1.
Figure 9:
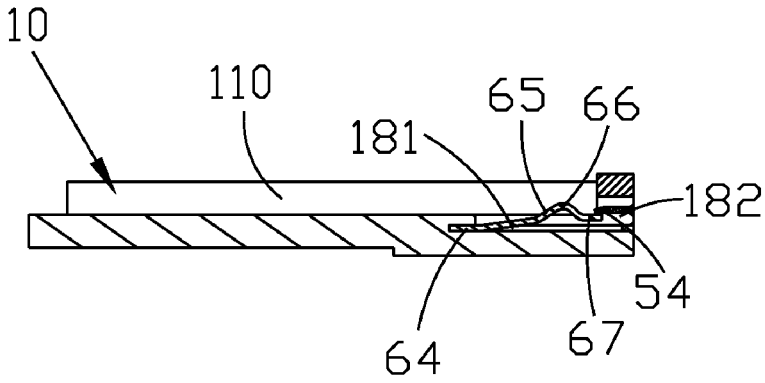
FIG. 9 is a cross-sectional view taken along line IX-IX of FIG. 7.

Referring to the FIGS. 3, 4 and 9, the receptacle channel 16 defines a first hole 17 and a second hole 18. The second hole 18 is deployed under the first hole 17. The first hole 17 has a first horizontal slot 171. A second vertical slot 172 extends downward from one side of the first horizontal slot 171 and gets through the bottom surface of the stopping bar 14. The first horizontal slot 171 extends backward throughout the stopping bar 14 so that the down surface of the first horizontal slot 171 and the top surface of the housing base 11 are in the same plane. The rear end of the second vertical slot 172 forms a first fixing slot 174. The second hole 18 defines a second horizontal slot 181 parallel to the first horizontal slot 171. The second horizontal slot 181 extends inwardly to the housing base 11. A connecting hole 182 is defined between the first horizontal slot 171 and the second horizontal slot 181. The horizontal slot 181 extends opposite to the second vertical slot 172, bends downwards to the bottom surface of the housing base 11, and then bends inwardly to form a receiving slot 183 which is a U-shaped structure laying an the side.

Figure 5:
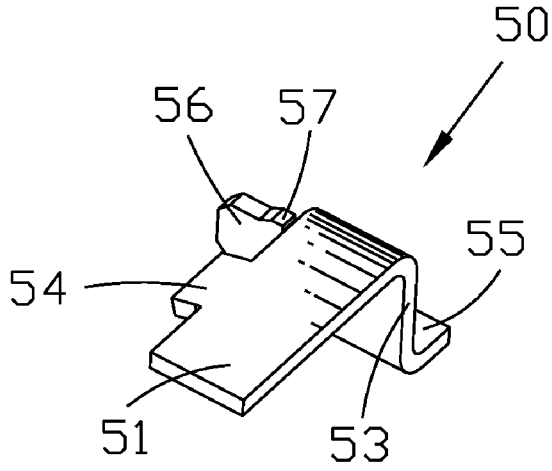
FIG. 5 is a perspective view of a fixing portion view of the SIM card connector.

Referring to the FIG. 5, the fixing portion 50 has a first contacting arm 51, the side of the first contacting arm 51 extends downwards to form a first fixing arm 53. The first fixing arm 53 bends horizontally to form a first welding arm 55. The front end of the first fixing arm 51 protrudes a first contacting piece 54. The front end of the first fixing arm 53 protrudes a first fixing piece 56. The upside and the downside of the first fixing piece 56 protrude a clasping splinter 57.

Figure 6:
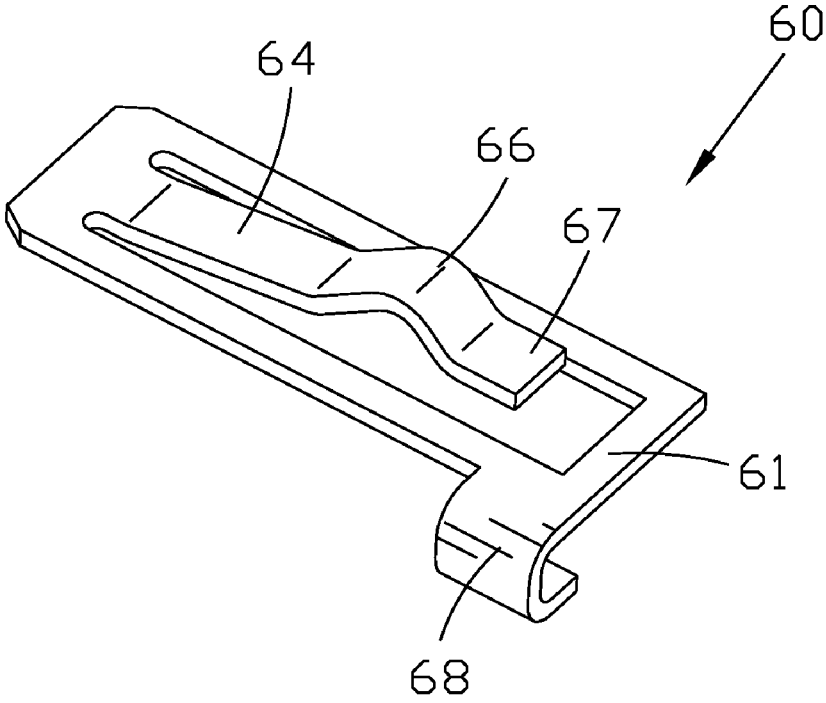
FIG. 6 is a perspective view of a contacting portion view of the SIM card connector.

Referring to the FIG. 6, the contacting portion 60 has a fixing plane 61 in rectangular shape. The fixing plane 61 is hollow. The inner part of the back end of the fixing plane 61 extends and slopes towards the upside of the fixing plane 61 to form a spring arm 64. The lateral of the front end of the fixing plane 61 extents downward and bends inwards sequentially, and forms a curve surface 68 in the end. The tip of the spring arm 64 bends downwards and forms an arced surface 66. The end of the arced surface 66 extends horizontally and forms a second contacting piece 67.

Figure 7:
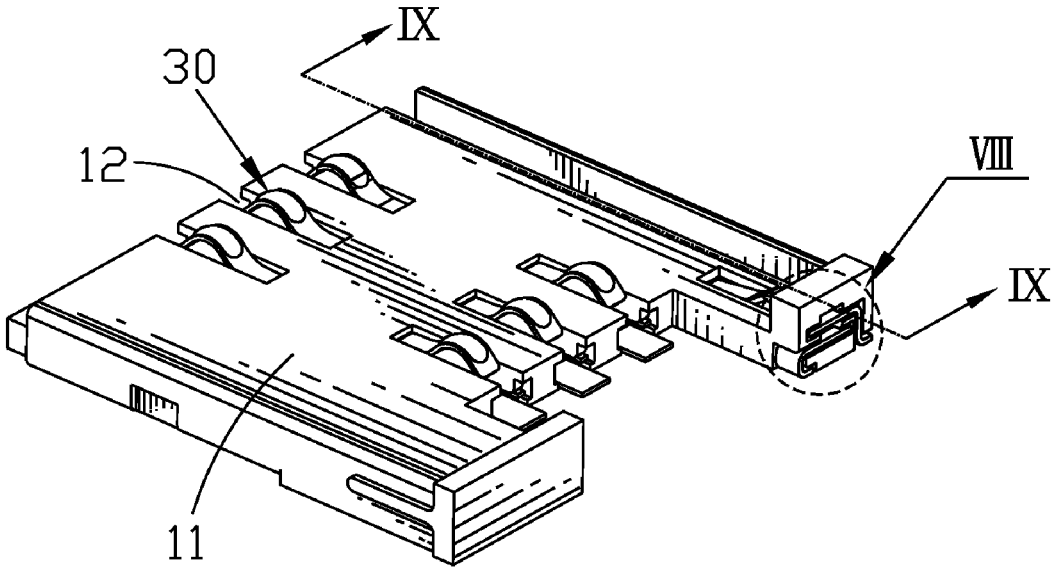
FIG. 7 is a perspective view of the connector body assembled with a terminal in a SIM card connector.

With reference to FIG. 7, the terminal 30 received in the groove 12 is arranged side-by-side in the housing base 11 of the connector body 10. The tip of the terminal 30 extends out of the groove 12, so that the SIM card (not shown in the figure) electrically connects to the terminal 30 when the SIM card is inserted into the receiving cavity 110 of the SIM card connector 100.

Figure 8:
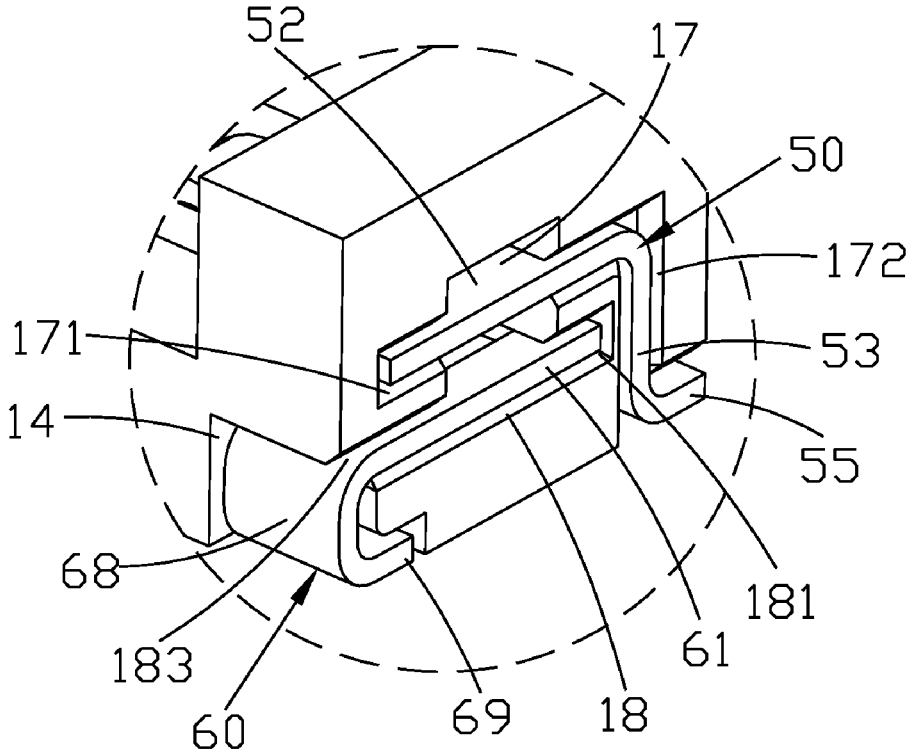
FIG. 8 is a partial enlarged view of VIII portion of FIG. 7.

With reference to FIGS. 8 and 9, each of the fixing portion 50 and the contacting portion 60 is received in the first hole 17 and the second hole 18 respectively. The first contacting arm 51 is inserted into the first horizontal slot 171. The first contacting piece 54 is located above the connector hole 182. The first fixing arm 53 is inserted into the second vertical slot 172. The first fixing piece 56 embeds in the first fixing slot 174 according to the clasping splinter 57. The first welding arm 55 extending out of the bottom surface of the SIM card connector 100 is used to weld the fixing portion 50 to the printed circuit board. The fixing plane 61 of the conducting portion 60 is inserted into the second hole 18 along the second horizontal slot 181. The spring arm 64 slopes to the upside of the connecting hole 182. The top of the arced surface 66 is inserted along the connector hole 182 and located in the receiving cavity 110 above the top surface of the housing base 11. The second contacting piece 67 elastically electrically contacts to the first contacting piece 54 without pressing the arced surface 66. The curve surface 68 arranges in the receiving slot 183 and is also used to weld the bottom surface thereof to the print circuit board.

Figure 11:
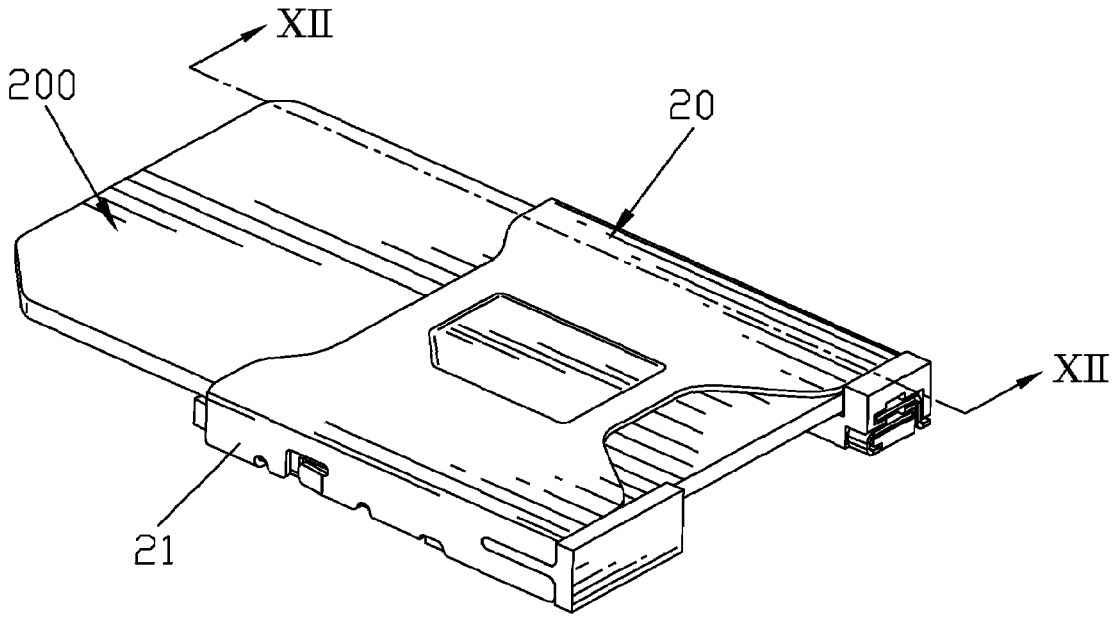
FIG. 11 is a perspective view of the SIM card connector assembled with a SIM card.
Figure 12:
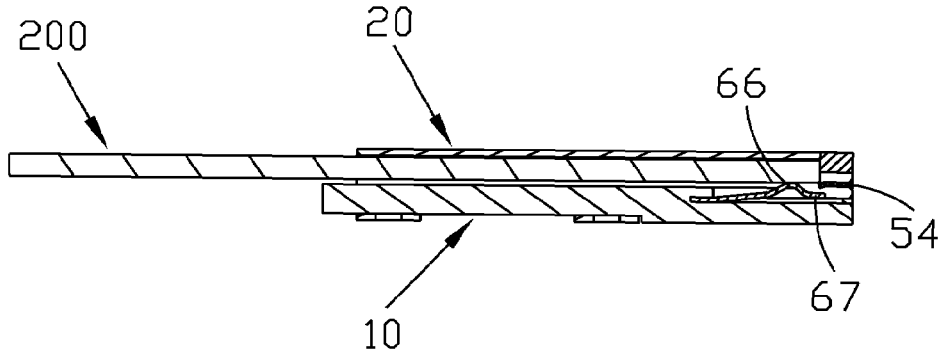
FIG. 12 is a cross-sectional view taken along line XII-XII of FIG. 11.
Figure 13:
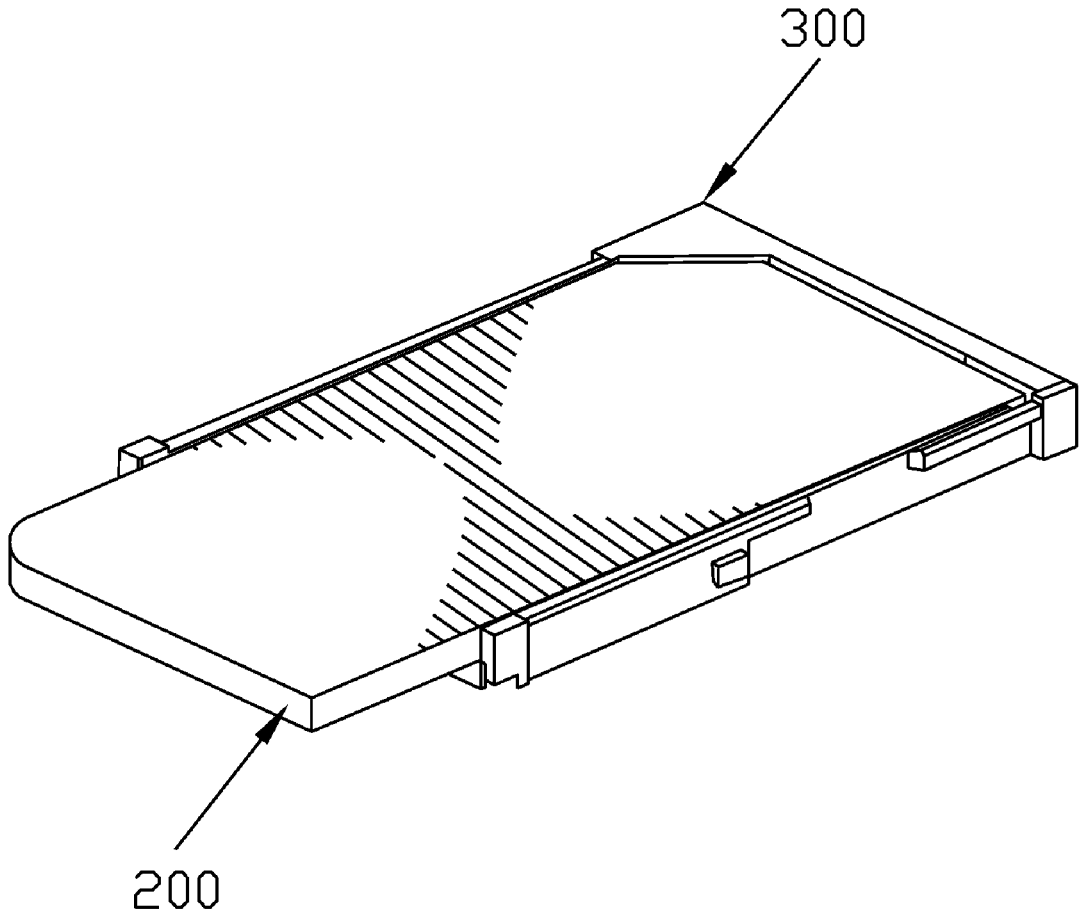
FIG. 13 is a perspective view showing a SIM card connector of prior art.

With reference to FIGS. 11 and 12, when the SIM card 200 is inserted into the receiving cavity 110 of the SIM Card connector 100 correctly, the SIM card 200 presses the contacting portion 60 downwards. The fixing portion 50 and a contacting portion 60 are separated each other. The end of the SIM card 200 presses the top of the arced surface 66 moving downwards to separate the second contacting piece 67 from the first contacting piece 54 to switch the switch terminal 40 off, so that the electric signal is obtained for computer to judge that the SIM card 200 is in corrective location. When the SIM card 200 is inserted into the receiving cavity 110 of the SIM Card connector 100 erroneously, the fixing portion 50 and a contacting portion 60 contact together. The triangle gap of the SIM card 200 locates on the side of the switch terminal 40. The electric signal cannot obtain from the second contacting piece 67 and the first contacting piece 54 after the SIM card 200 inserting into the SIM card connector 100.

It is to be noted that the switch terminal 40 arranged in the SIM card connector 100 avoids the damage of the collision between the SIM card 200 and the SIM card connector 100 when the SIM card 200 is erroneously inserted into the SIM card connector 100.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A SIM card connector, comprising:

a connector body having a housing base for receiving a SIM card, the connector body having a receptacle channel that extends inwardly from a front portion of the connector body, the receptacle channel further defining a first hole and a second hole;

a plurality of terminals mounted in a middle portion of the connector body;

a switch terminal mounted in the connector body, wherein the housing base has a flat top surface defining part of a receiving cavity for receiving a SIM card;

wherein the switch terminal has a fixing portion received in the first hole and a contacting portion received in the second hole, the contacting portion forms an spring arm, and the spring arm forms an arced surface, a top of the arced surface is positioned in the second hole and protrudes above the top surface of the housing base in the receiving cavity; and wherein the fixing portion has a first contacting arm;

wherein the contacting portion has a fixing plane in rectangular shape, the fixing plane having an aperture, an inner part of a back end of the aperture of the fixing plane extends and slopes towards an upside of the fixing plane to form the spring arm;

wherein the spring arm makes electrical contact with the first contacting arm when no SIM card is in the receiving cavity, and insertion of the SIM card into the receiving cavity allows the SIM card to bias the top of the arced surface downwards, thereby disconnecting electrical contact between the spring arm and the fixing portion.

2. The SIM card connector as claimed in claim 1, wherein the housing base has a pair of sidewalls extending upwardly from two opposite sides thereof and a stopping bar extending upwardly from a front end of the housing base.

3. The SIM card connector as claimed in claim 1, wherein the side of the first contacting arm extends downwards to form a first fixing arm, the first fixing arm bends horizontally to form a first welding arm, a front end of the first fixing arm protrudes a first contacting piece, and the front end of the first fixing arm protrudes a first fixing piece.

4. The SIM card connector as claimed in claim 1, wherein a lateral of a front end of the fixing plane extents downward and bends inwards sequentially, and forms a curve surface in an end, wherein a tip of the spring arm bends downwards and forms said arced surface, and an end of said arced surface extends horizontally and forms a second contacting piece; wherein the second contacting piece makes electrical contact with the first contacting arm when no SIM card is in the receiving cavity, and insertion of the SIM card into the receiving cavity allows the SIM card to bias the top of the arced surface downwards, thereby disconnecting electrical contact between the spring arm and the fixing portion.

* * * * *